US011707832B2

(12) United States Patent
Hurley

(10) Patent No.: US 11,707,832 B2
(45) Date of Patent: Jul. 25, 2023

(54) TOOL ORGANIZER

(71) Applicant: Jonathan Hurley, Tacoma, WA (US)

(72) Inventor: Jonathan Hurley, Tacoma, WA (US)

( * ) Notice: Subject to any disclaimer, the term of this patent is extended or adjusted under 35 U.S.C. 154(b) by 19 days.

(21) Appl. No.: 17/114,310

(22) Filed: Dec. 7, 2020

(65) Prior Publication Data

US 2022/0176543 A1 Jun. 9, 2022

(51) Int. Cl.
*B25H 3/06* (2006.01)

(52) U.S. Cl.
CPC ..... *B25H 3/06* (2013.01)

(58) Field of Classification Search
CPC ..... B25H 3/023; B25H 3/026; B25H 3/021; B25H 3/04; B25H 3/022; B25H 3/003; B25H 3/00; Y10S 211/01; B65D 25/10; H01F 7/02
USPC ..... 206/378, 376, 377; 220/23.7, 23.4, 220/23.83; 211/70.6, 103
See application file for complete search history.

(56) References Cited

U.S. PATENT DOCUMENTS 1,809,450 A * 6/1931 Platt ..... B25B 13/56 206/376
1,900,915 A * 3/1933 Costello ..... B25B 13/56 206/376
1,922,102 A * 8/1933 Kroecker ..... B25B 13/56 24/17 R
2,066,851 A 1/1937 Noyes et al.
2,068,308 A * 1/1937 Zerver ..... B25B 13/56 206/376
2,119,217 A * 5/1938 Rocchi ..... B25B 13/56 70/61
2,371,433 A * 3/1945 Davis ..... B25H 3/04 211/94.01
2,541,597 A * 2/1951 Midling ..... C25D 17/08 211/113

(Continued)

FOREIGN PATENT DOCUMENTS

CN 205904991 U 1/2017
GB 2 420 963 A 6/2006

OTHER PUBLICATIONS

First Office Action dated Jan. 6, 2022, with Search Report, issued in Chinese Application No. 201880095833.7, filed Oct. 8, 2018, 13 pages.

(Continued)

*Primary Examiner* — Steven A. Reynolds
*Assistant Examiner* — Prince Pal
(74) *Attorney, Agent, or Firm* — Christensen O'Connor Johnson Kindness PLLC

(57) ABSTRACT

A modular tool holder 20 includes upright bodies 22 composed of a generally U-shaped riser 24 extending upwardly from base sections 26. Horizontally extending tongues 28 project from one side of each base 26, and complementary horizontally extending grooves 30 are formed in the opposite side of each base. One or more spacers 32, 34, 35, 36, 38, and 40 is/are positioned between the base sections 26 of the bodies 22. The spacers can be of various configurations to receive and hold various tools such as screw drivers, wrenches and plyers. The bodies 22 and spacers can be assembled in innumerable configurations to accommodate different tools sets in drawers and toolboxes, on work benches and in other locations.

19 Claims, 12 Drawing Sheets

(56) References Cited

U.S. PATENT DOCUMENTS 2,580,099 A * 12/1951 Jaeger ..... B25H 3/04 211/DIG. 1
2,619,829 A 12/1952 Tatum
2,907,137 A 10/1959 Ehrmann
3,370,696 A * 2/1968 Groe ..... B25B 13/56 211/70.6
4,114,241 A * 9/1978 Bisping ..... F16L 3/13 248/68.1
RE30,435 E * 11/1980 Fukao ..... B41J 5/16 235/145 R
4,286,952 A 9/1981 Roche
4,305,221 A 12/1981 Chatani
4,306,697 A * 12/1981 Mathews ..... F16L 3/222 248/68.1
4,406,368 A 9/1983 Hermes
4,410,095 A 10/1983 Dembicks
4,621,738 A 11/1986 DeLucchi
4,770,297 A * 9/1988 Chang ..... B65D 85/28 206/379
4,928,821 A 5/1990 Belko, Jr.
5,054,636 A * 10/1991 Netzer ..... B65D 67/02 24/456
5,080,230 A 1/1992 Winnard
5,217,115 A 6/1993 Purkapile
5,284,245 A 2/1994 Slivon et al.
5,301,822 A 4/1994 Coleman et al.
5,313,181 A 5/1994 Negus
5,320,223 A 6/1994 Allen
5,378,184 A 1/1995 Bro et al.
5,398,823 A 3/1995 Anders
5,407,063 A 4/1995 Warner et al.
5,409,560 A 4/1995 Hammer et al.
5,512,165 A 4/1996 Liu
5,520,285 A 5/1996 Mursch et al.
5,535,881 A * 7/1996 Krivec ..... B25H 3/003 206/483
5,542,320 A 8/1996 Vasichek et al.
5,544,396 A 8/1996 Mekyska
5,551,320 A 9/1996 Horobec et al.
5,551,795 A 9/1996 Engibarov
5,638,964 A 6/1997 Ernst
5,645,177 A * 7/1997 Lin ..... B25H 3/04 211/69.5
5,660,276 A 8/1997 Winnard
5,669,516 A 9/1997 Horn
5,695,165 A 12/1997 Moriarty
5,743,394 A 4/1998 Martin
5,760,668 A 6/1998 Testa et al.
5,833,465 A 11/1998 Jarzewiak
5,855,285 A * 1/1999 Laird ..... B25H 3/003 206/378
5,884,782 A 3/1999 Dembicks
5,979,675 A 11/1999 Moriarty
6,044,971 A * 4/2000 Esposito ..... A61B 17/1222 206/339
6,047,824 A 4/2000 Winnard
6,047,827 A 4/2000 Huang
6,073,766 A 6/2000 Winnard
6,098,799 A 8/2000 Lee
6,109,569 A * 8/2000 Sakaida ..... F16L 3/222 248/62
6,237,767 B1 5/2001 Lee
6,390,298 B1 5/2002 Garro
6,405,864 B1 6/2002 Streich et al.
6,415,922 B1 7/2002 Lee
6,450,338 B1 9/2002 Chen
6,516,948 B1 2/2003 Caballero
6,595,735 B1 7/2003 Lee
6,637,082 B1 10/2003 Chang
6,698,600 B1 * 3/2004 Lee ..... B25H 3/003 206/378
6,719,155 B1 4/2004 Chang
6,811,127 B1 11/2004 Shiao
6,827,275 B2 12/2004 Allen
6,868,967 B2 3/2005 Lam
6,932,223 B1 8/2005 Lee et al.
7,185,770 B1 * 3/2007 Roten ..... A47B 81/00 211/70.6
7,246,704 B2 7/2007 Brunson et al.
7,286,059 B2 10/2007 Drake
7,322,470 B2 1/2008 Brunson
7,424,958 B1 9/2008 Eley
7,510,092 B2 3/2009 Sholem
7,533,852 B2 * 5/2009 Stigler ..... F16L 3/223 248/65
7,622,682 B2 * 11/2009 Malin ..... H02G 3/32 174/72 A
7,735,645 B2 6/2010 Joyce et al.
7,837,033 B2 11/2010 Schein et al.
7,905,354 B1 3/2011 Geibel
8,020,259 B2 * 9/2011 Ho ..... F16L 3/223 24/339
8,118,162 B1 2/2012 McEwin et al.
8,181,780 B1 5/2012 Guffey et al.
8,272,628 B2 9/2012 Winnard
8,308,408 B2 * 11/2012 Gaudette ..... B60P 7/15 410/43
8,336,709 B1 12/2012 Geibel
8,403,155 B1 * 3/2013 Kao ..... B25H 3/04 211/70.6
8,505,720 B2 8/2013 Huang
8,505,748 B2 8/2013 Jones et al.
8,739,453 B1 6/2014 Conner
9,205,553 B2 12/2015 Ou
9,238,301 B2 1/2016 Streich et al.
9,962,827 B2 5/2018 Kao
10,022,857 B2 7/2018 Kao
10,052,754 B1 8/2018 Coleman, Jr. et al.
10,099,363 B1 10/2018 Hsieh
10,213,913 B2 2/2019 Pang
10,279,467 B2 5/2019 Ou
10,335,664 B2 7/2019 Jacques
10,625,411 B2 4/2020 Tesoroni
10,675,750 B1 6/2020 Winnard et al.
10,842,264 B1 11/2020 Savryha et al.
11,103,989 B2 * 8/2021 Hurley ..... B25H 3/003
11,110,589 B2 9/2021 Hurley
2003/0016993 A1 * 1/2003 Chen ..... B25H 3/003 403/329
2003/0141266 A1 * 7/2003 Lin ..... B25H 3/04 211/70.6
2004/0140356 A1 7/2004 Mien
2004/0140362 A1 7/2004 Mien
2004/0238466 A1 12/2004 Shiao
2004/0256335 A1 12/2004 Sholem
2005/0221664 A1 10/2005 Winnard
2005/0258059 A1 11/2005 Joyce et al.
2006/0065557 A1 3/2006 Brunson
2006/0070900 A1 4/2006 Brunson et al.
2006/0082466 A1 4/2006 Drake
2006/0091986 A1 5/2006 Coleman et al.
2006/0234846 A1 10/2006 Tucker
2007/0144986 A1 6/2007 Hill
2009/0072029 A1 3/2009 Martin
2009/0101532 A1 4/2009 Huot
2009/0166305 A1 7/2009 Hsieh
2009/0218302 A1 * 9/2009 Winnard ..... B25H 3/003 211/70.6
2009/0255891 A1 10/2009 Lanning
2011/0204051 A1 * 8/2011 Pawl ..... B65D 21/0231 29/428
2014/0083886 A1 3/2014 Winterrowd et al.
2015/0122750 A1 5/2015 Kao
2015/0202767 A1 7/2015 Kao
2015/0251310 A1 9/2015 Ou
2015/0252827 A1 * 9/2015 Ou ..... B25H 3/04 211/13.1
2015/0273683 A1 10/2015 Ou
2015/0328768 A1 11/2015 Martin
2016/0016306 A1 1/2016 Haddon et al.
2016/0121478 A1 * 5/2016 Schein ..... B25H 3/06 206/350

(56) References Cited

U.S. PATENT DOCUMENTS

| | | | | |
|---|---|---|---|---|
| 2016/0214254 | A1 | 7/2016 | Ou | |
| 2017/0190046 | A1 | 7/2017 | Winnard | |
| 2017/0274522 | A1 | 9/2017 | Kao | |
| 2017/0341218 | A1 | 11/2017 | Maruzzo et al. | |
| 2018/0104812 | A1* | 4/2018 | Wacker | B25H 3/04 |
| 2018/0137789 | A1 | 5/2018 | Murray, III et al. | |
| 2018/0232577 | A1 | 8/2018 | Lipsey et al. | |
| 2018/0326573 | A1 | 11/2018 | Tesoroni | |
| 2018/0353830 | A1 | 12/2018 | Jacques | |
| 2018/0361563 | A1 | 12/2018 | Hurley | |
| 2018/0361564 | A1* | 12/2018 | Hurley | B25H 3/04 |
| 2019/0061139 | A1* | 2/2019 | Kao | B65D 25/101 |
| 2020/0122315 | A1* | 4/2020 | Hurley | B25H 3/003 |
| 2021/0038732 | A1 | 12/2021 | Hurley | |

OTHER PUBLICATIONS

International Search Report and Written Opinion dated Feb. 3, 2022, issued in International Patent Application No. PCT/US2021/059362, filed Nov. 15, 2021, 9 pages.

Toolbox Widget, "Angled Wrench Organizers | Modular Angled Large Wrench Organizers," <https://toolboxwidget.com/products/toolbox-large-wrench-organizers?variant=15690168729666> (retrieved Jan. 30, 2020), as early as Aug. 10, 2020, 2 pages.

Toolbox Widget, "Modular Toolbox Screwdriver Organizers | Toolbox Screwdriver Holder," <https://toolboxwidget.com/products/toolbox-screwdriver-organizers> (retrieved Jan. 30, 2020), as early as Aug. 10, 2020, 2 pages.

Toolbox Widget, "Modular Wrench Organizers for Toolbox | Vertical Wrench Organizers," <https://toolboxwidget.com/products/toolbox-wrench-organizer?variant=12674192867394> (retrieved Jan. 30, 2020), as early as Aug. 2020, 13 pages.

Dhartv, "A Must Buy for Anyone who Wants to Organize Their Wrenches!!! E-Z Red Magnetic Wrench Rack", retrieved from the Internet <URL:www.youtube.com/watch?v=d3z6HwUOv6M>, 0:14-0:24, 0:38-0:46, 2:00-2:06. 2:10-2:24. 3:35, 3:55-4:096 Apr. 2017 (Transcript and stills provided).

Toolbox Widget, "The Toolbox Widget", retrieved from the Internet <URL:www.youtube.com/watch?v=L4cdCFAOg2o>, entire video, Aug. 5, 2017 (Transcript provided and stills provided).

International Search Report and Written Opinion dated Apr. 25, 2018, in PCT/US2018/015429, filed Jan. 26, 2018, 7 pages.

International Search Report and Written Opinion dated Dec. 21, 2018, in PCT/US2018/054887, filed Oct. 8, 2018, 8 pages.

International Preliminary Report on Patentability dated Feb. 4, 2021, in PCT/US2018/054887, filed Oct. 8, 2018, 7 pages.

International Search Report and Written Opinion dated Feb. 22, 2021, issued in corresponding International Patent Application No. PCT/US2020/062792, filed Dec. 2, 2020, 9 pages.

International Preliminary Report on Patentability dated Dec. 26, 2019, in PCT/US2018/015429, filed Jan. 26, 2018, 7 pages.

* cited by examiner

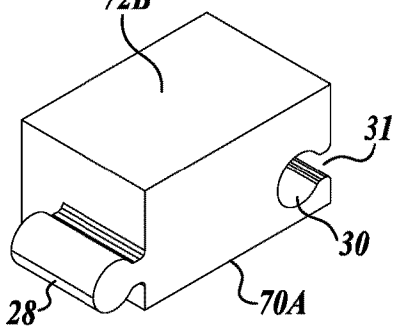
FIG. 6A
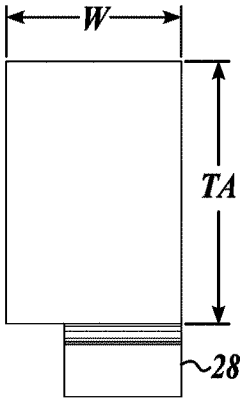
FIG. 6C
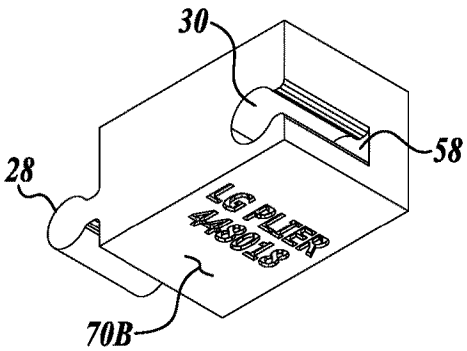
FIG. 6B
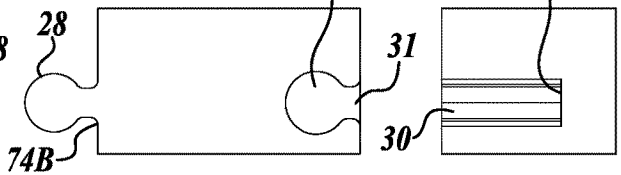
FIG. 6D
FIG. 6G
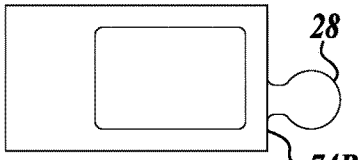
FIG. 6H
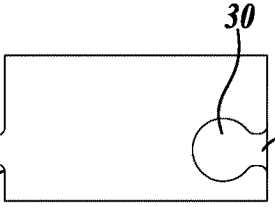
FIG. 6F
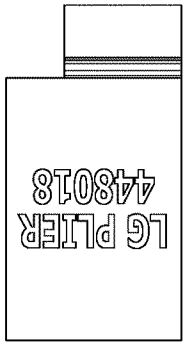
FIG. 6E

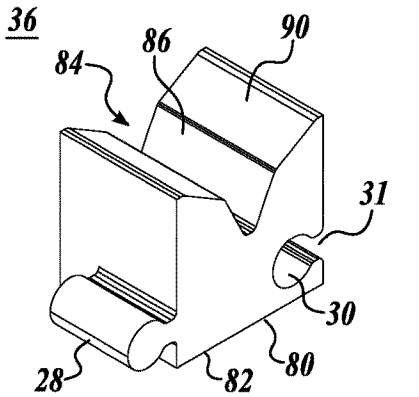
FIG. 7A
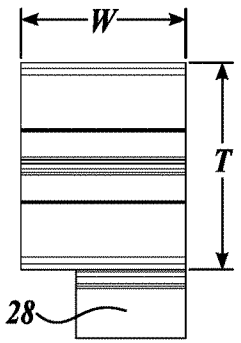
FIG. 7C
FIG. 7D
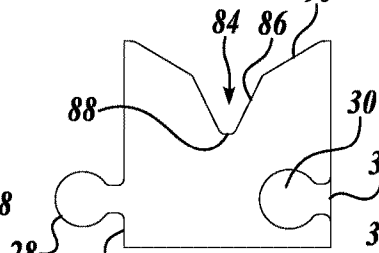
FIG. 7F
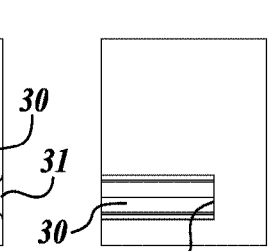
FIG. 7G
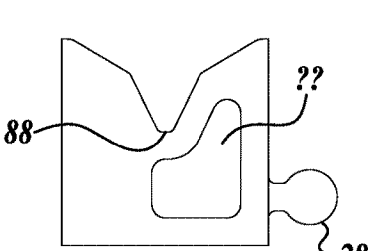
FIG. 7H
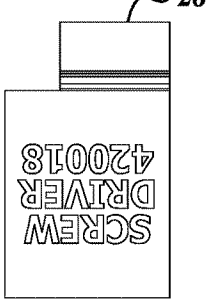
FIG. 7E
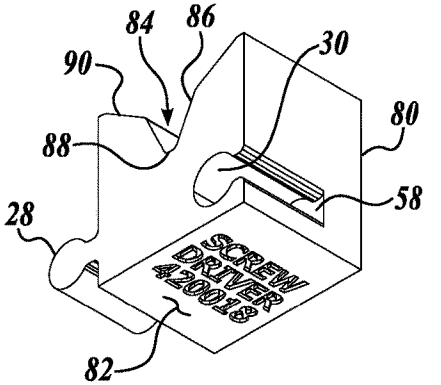
FIG. 7B

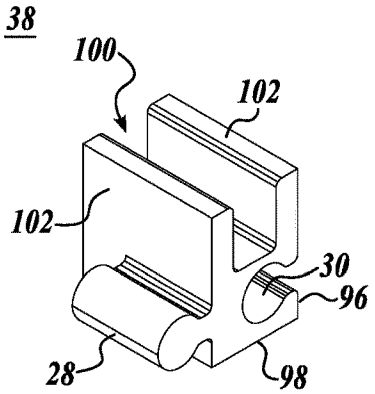
FIG. 8A
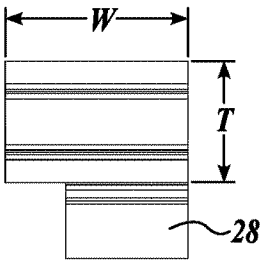
FIG. 8C
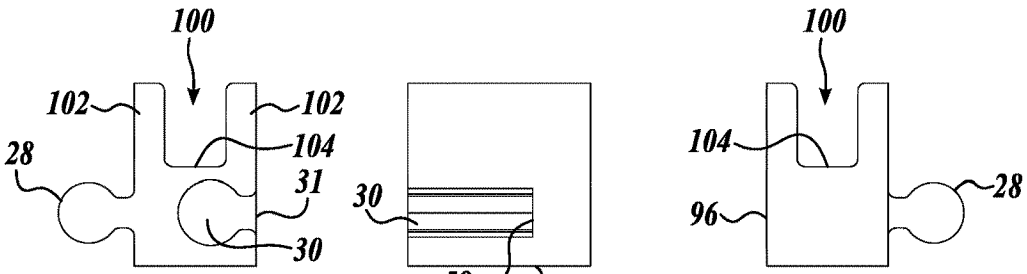
FIG. 8F
FIG. 8G
FIG. 8H
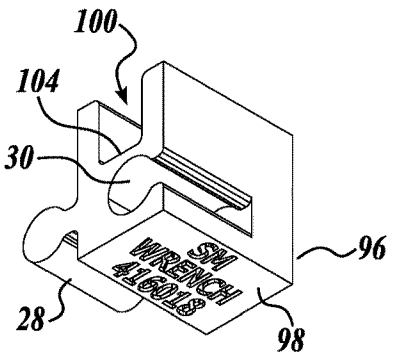
FIG. 8B
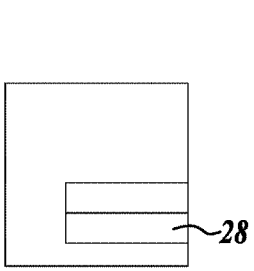
FIG. 8D
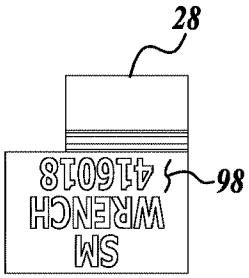
FIG. 8E

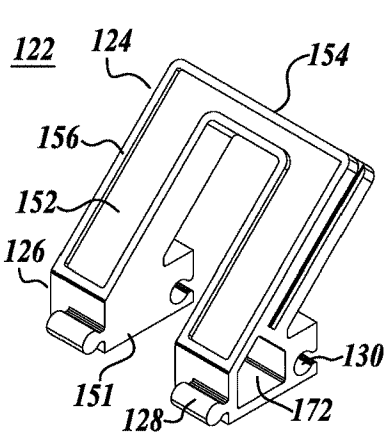
FIG. 10A
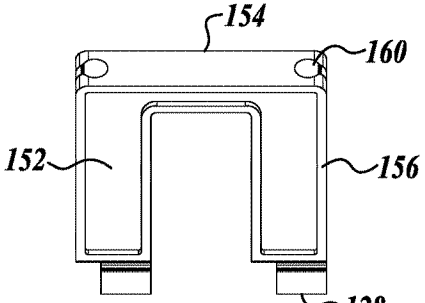
FIG. 10C
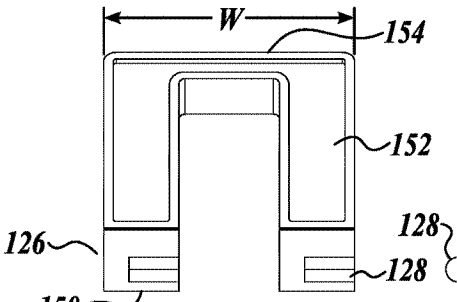
FIG. 10D
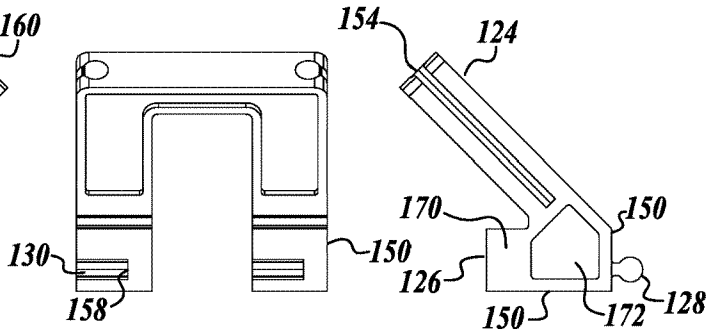
FIG. 10F
FIG. 10H
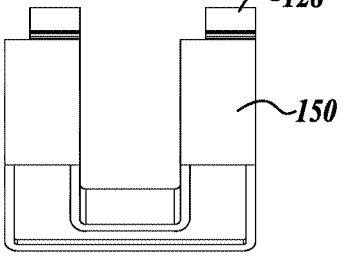
FIG. 10E
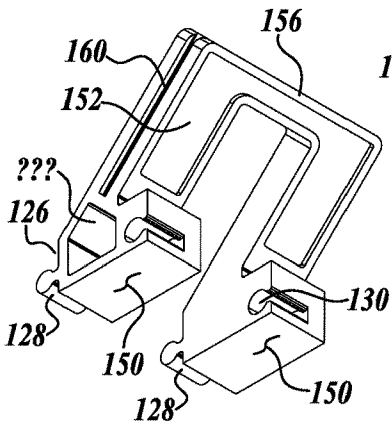
FIG. 10B
FIG. 10G

TOOL ORGANIZER

BACKGROUND

There are currently no practical and inexpensive products available to the "do it yourself" ("DIY") consumer for the custom organization of tools for storage. Most DIY individuals keep their wrenches, screw drivers, plyers, etc., stored in tool boxes, drawers or other containers. Because the tools typically are stored together with little or no organization within the tool box or drawer, it is often difficult to find a particular tool needed for use, due to the lack of organization of the tools.

Therefore, there is a need for a device that facilitates easy storing and organizing of tools within a tool box and/or drawer. There is also a need for an inexpensive device for the DIY individual that facilitates easy storing and organizing of numerous different tools. The present disclosure seeks to address this need.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with an embodiment of the present disclosure, a modular tool holder is provided, comprising: at least one upwardly extending body defining a height and a width, the body comprising a base and the riser extending upwardly from the base, the riser defining the width and height of the body; at least one spacer defining a height and a width, the spacer comprising a base; the body base and the spacer base each defining at least one groove formed therein and at least one tongue projecting from the body base and the spacer base to be engageable within the groove of an adjacent body base or spacer base; and at least one spacer disposable between adjacent bodies for holding a tool.

In accordance with another embodiment of the present disclosure, a modular tool holder is provided, comprising: at least one upwardly extending body defining a height and a width, the body comprising laterally spaced apart legs each extending upward form a base section and a bridge section spanning the spaced apart legs a location spaced from the leg base sections; at least one tool supporting spacer defining a height and a width, the spacer comprising a base section; the body and the spacer base sections each defining at least one groove formed therein and at least one tongue projecting from the body and the spacer base sections to be engageable within the groove of an adjacent body or spacer base section; and at least one spacer disposable between adjacent bodies for supporting a tool between the adjacent bodies.

In any of the embodiments disclosed or described herein, the body riser comprising: laterally spaced apart legs extending upwardly from the body base, the legs defining a gap therebetween, with the legs and the gap defining the width of the body; and a bridge section spanning the spaced apart legs at a location distal from the body base.

In any of the embodiments disclosed or described herein, wherein the legs have upper end portions, and the bridge section spanning the upper end portions of the legs.

In any of the embodiments disclosed or described herein, wherein the legs have a width, and the spacer is a width corresponding to the width of the legs.

In any of the embodiments disclosed or described herein, wherein an upwardly open groove is formed in the spacer for receiving a tool downwardly therein.

In any of the embodiments disclosed or described herein, wherein the upwardly open groove is defined by side surfaces and a groove base.

In any of the embodiments disclosed or described herein, wherein the side surfaces of the groove are sloped.

In any of the embodiments disclosed or described herein, wherein the body comprises an integral spacer section projecting from the body base, with the at least one groove formed in the integral spacer section and the at least one tongue projecting from the body base.

In any of the embodiments disclosed or described herein, wherein the body riser defines side edges and a groove extending along the riser side edges.

In any of the embodiments disclosed or described herein, further comprising connectors engageable into the grooves extending along the riser side edges to interconnect the risers of adjacent bodies in side-by-side relationship to each other.

In any of the embodiments disclosed or described herein, wherein the connectors define side-by-side tongue sections.

In any of the embodiments disclosed or described herein, wherein the riser extends upwardly from the body base at a diagonal orientation.

In any of the embodiments disclosed or described herein, wherein the bridge section defines the height of the body.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIGS. 6A-6H illustrate another spacer component of the modular tool holder of FIG. 1;

FIGS. 7A-7H illustrate another spacer component of the modular tool holder of FIG. 1;

FIGS. 8A-8H illustrate another spacer component of the modular tool holder of FIG. 1;

FIGS. 10A-10H illustrate another body component of the modular tool holder of FIG. 1;

DETAILED DESCRIPTION

Figure 1:
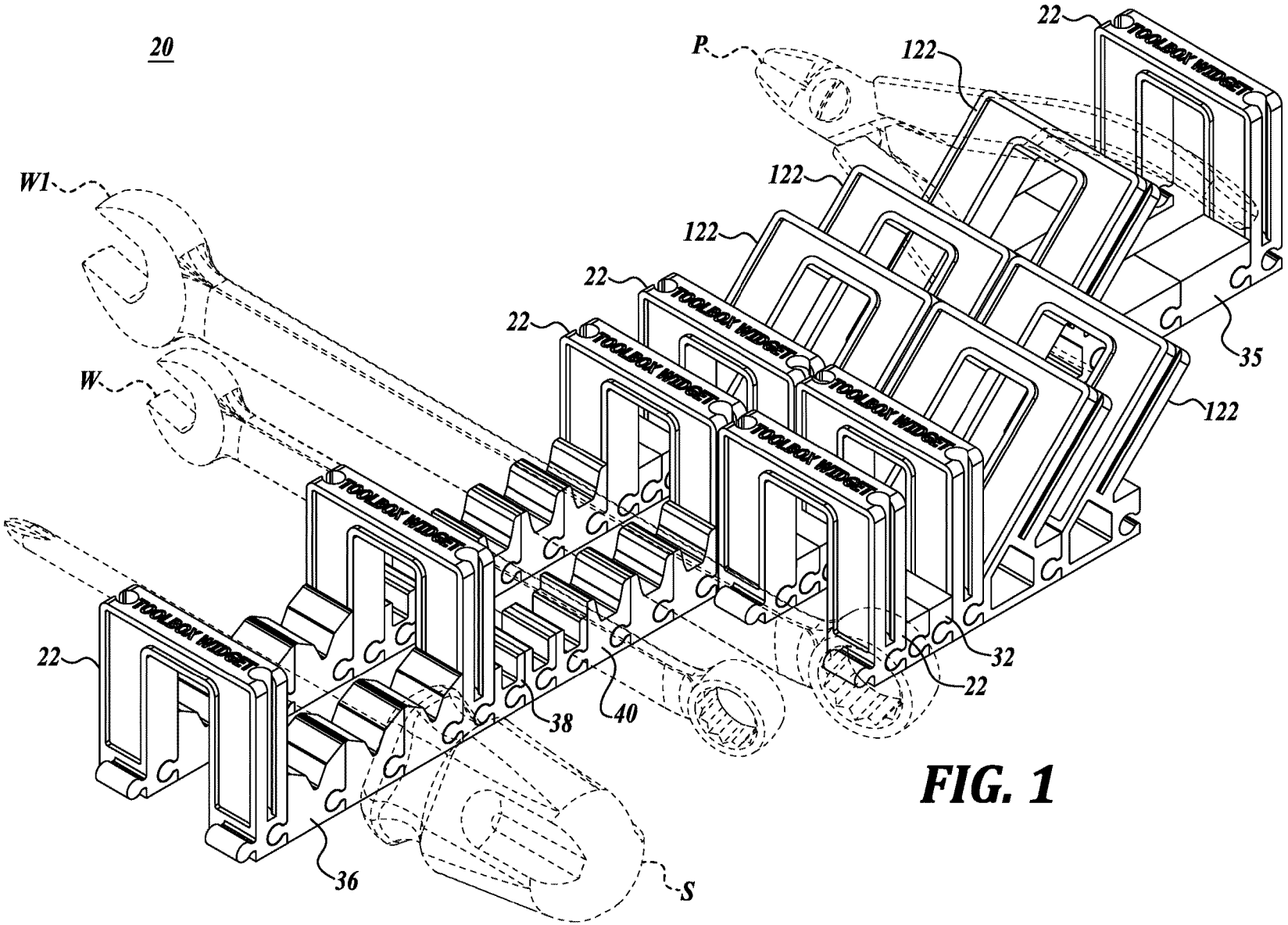
FIG. 1 illustrates an embodiment of a modular tool holder of the present disclosure assembled in one possible configuration for holding tools.

Various example embodiments of the present disclosure are described below with reference to the accompanying drawings in which some example embodiments are illustrated. In the figures, the thicknesses of lines, layers and/or regions may be exaggerated for clarity.

While example embodiments are capable of various modifications and alternative forms, embodiments thereof are shown by way of example in the figures and are described in detail below. It should be understood, however, that there is no intent to limit example embodiments to the particular forms disclosed, but on the contrary, example embodiments are to cover all modifications, equivalents, and alternatives falling within the scope of the disclosure.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be considered in the specific context this definition is given herein.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. Further, it will be appreciated that embodiments of the present disclosure may employ any combination of features described herein.

The present application may include references to directions, such as "forward," "rearward," "front," "back," "ahead," "behind," "upward," "downward," "above," "below," "top," "bottom," "right hand," left hand," "in," "out," "extended," "advanced," "retracted," "proximal," "distal," "central," "vertical," etc. These references and other similar references in the present application are only to assist in helping describe and understand the present invention and are not intended to limit the present invention to these directions or locations.

The present application may also reference quantities and numbers. Unless specifically stated, such quantities and numbers are not to be considered restrictive, but exemplary of the possible quantities or numbers associated with the present application. Also, in this regard, the present application may use the term "plurality" to reference a quantity or number. In this regard, the term "plurality" is meant to be any number that is more than one, for example, two, three, four, five, etc.

The present application may include modifiers such as the words "generally," "approximately," "about", or "substantially." These terms are meant to serve as modifiers to indicate that the "dimension," "shape," "temperature," "time," or other physical parameter in question need not be exact, but may vary as long as the function that is required to be performed can be carried out. For example, in the phrase "generally circular in shape," the shape need not be exactly circular as long as the required function of the structure in question can be carried out. If a quantitative value is needed to render the applicable parameter sufficiently definite, the applicable parameter is within five percent (5%) of the designated parameter value.

In the following description, various embodiments of the present disclosure are described. In the following description and in the accompanying drawings, the corresponding systems assemblies, apparatus and units may be identified by the same part number, but with an alpha suffix or by a prime ("") or double prime ("") or even a triple prime ("") designation. The descriptions of the parts/components of such systems assemblies, apparatus, and units that are the same or similar are not repeated so as to avoid redundancy in the present application.

Referring initially to FIG. 1, a modular tool holder 20 is illustrated in as assembled in one of innumerable assembled configurations. The modular tool holder 20 includes upright bodies 22 composed of a generally U-shaped riser 24 extending upwardly from base sections 26. Horizontally extending tongues 28 project from one side of each base 26, and complementary horizontally extending grooves 30 are formed in the opposite side of each base.

One or more spacers is positioned between the base sections 26 of the bodies 22. The spacers can be of various configurations including, for example, a "standard" spacer 32 having a horizontal or flat top surface at an elevation a short distance upwardly relative to the height of the body riser 24 to support a tool on the top surface. Spacers 34 and 35 are both of similar construction to spacer 32, but having a greater thickness T so as to provide larger distances between risers to support tools therebetween. Further, another spacer 36 is configured to support a screwdriver S or similar type tool. Also, spacers 38 and 40 are configured to support wrenches W or similar tools.

Horizontally extending tongues 28 project from one side of the base of each of the spacers, and complementary horizontally extending grooves 30 are formed in the opposite side of the base of the spacers, in the same manner as the tongues 28 and grooves 30 of the bodies 22.

Next, describing the embodiments of the tool holder 20 in greater detail, as noted above the body 22 is in the form of a generally U-shaped riser 24 with base sections 26 having a flat bottom 50 upon which the body rests. The riser 24 is formed by spaced-apart legs 52 extending upwardly from the base section 26, defining a gap 53 therebetween. A bridge section 54 spans horizontally across the upper ends of the legs 52 to complete the U-shape of the body riser 24. The width W of the body is defined by the width of the legs 50 together with the width of the gap 53, while the height H of the body is defined by the height of the base 26 and legs 52.

To enhance the structural integrity of the body 22, a perimeter rim 56 extends perpendicularly to the substantially planar legs and bridge section. This construction enables the legs and bridge section to be constructed with a thinner wall section, thereby reducing the material requirement for the body, but without sacrificing strength.

As shown in FIGS. 3A, 3B, 3D and 3E, tongues 28 project from one side of the body bases 26 in horizontal orientation. The tongues extend along one side of the edges of the legs 50, but do not extend the full width of the of the body bases 26. The reason for this is that the tongues bottom against the ends of grooves 30 formed in either the opposite side of the body bases 26 or in the various spacers 32-40.

Figure 3A:
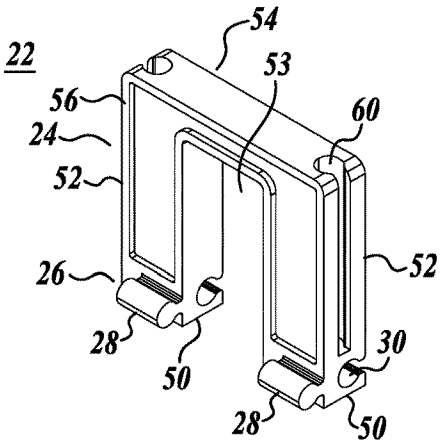
FIGS. 3A-3H illustrate a body component of the modular tool holder of FIG. 1.
Figure 3C:
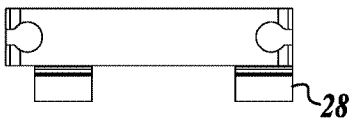
Figure 3D:
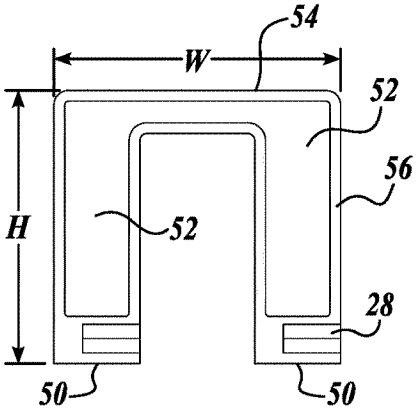
Figure 3F:
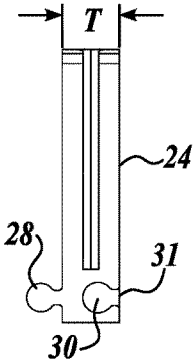
Figure 3G:
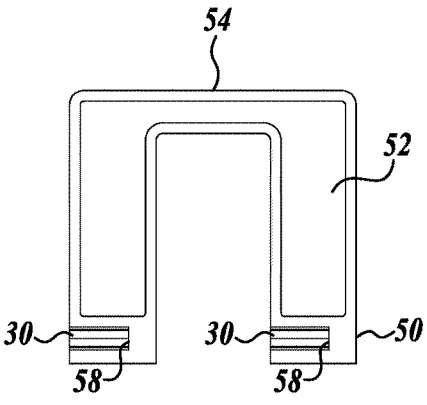
Figure 3H:
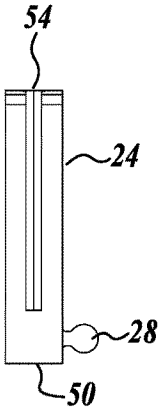
Figure 3E:
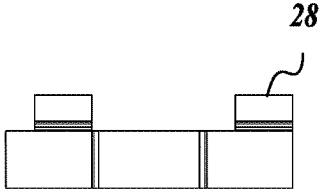
Figure 3B:
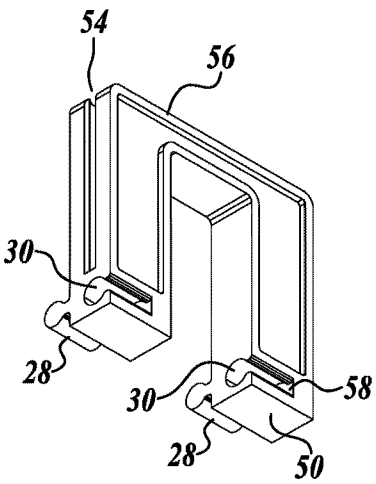
Figure 4A:
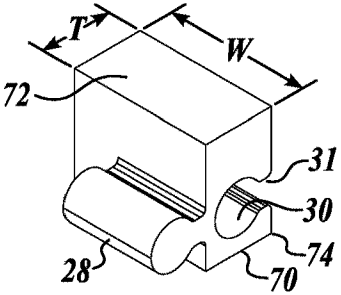
FIGS. 4A-4H illustrate a spacer component of the modular tool holder of FIG. 1.
Figure 4B:
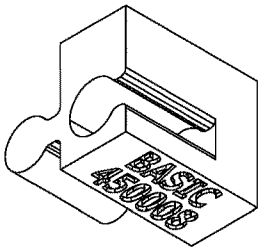
Figure 4C:
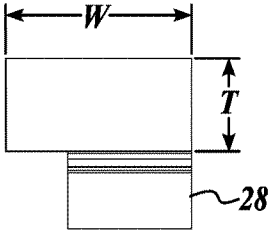
Figure 4D:
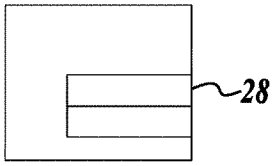
Figure 4E:
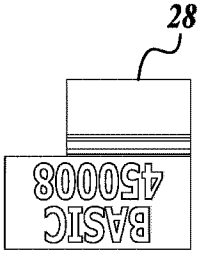
Figure 4F:
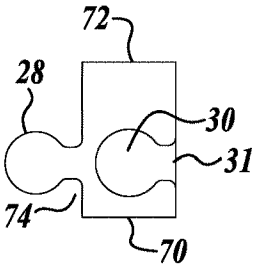
Figure 4G:
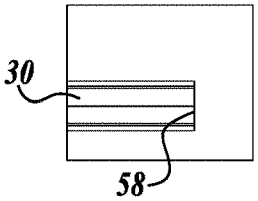
Figure 4H:
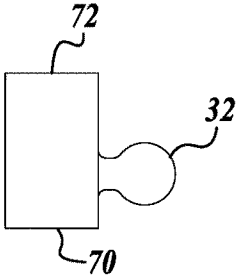
Figure 5A:
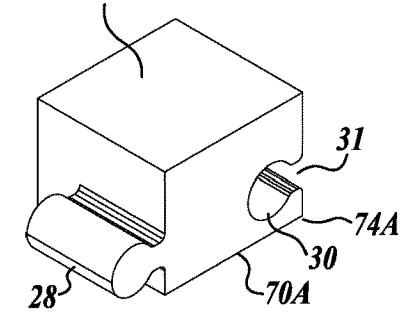
FIGS. 5A-5H illustrate another spacer component of the modular tool holder of FIG. 1.
Figure 5B:
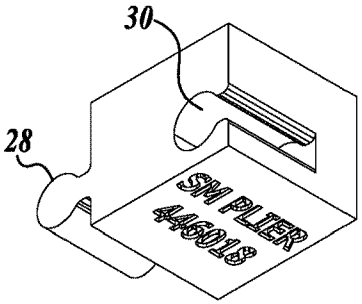
Figure 5C:
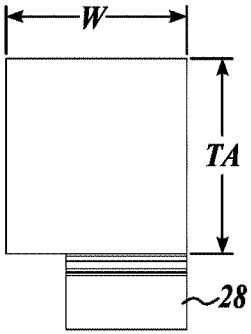
Figure 5D:
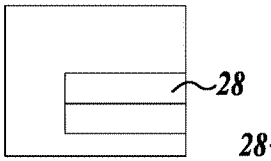
Figure 5E:
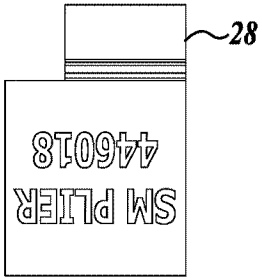
Figure 5F:
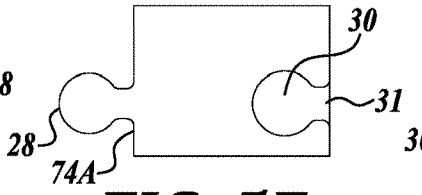
Figure 5G:
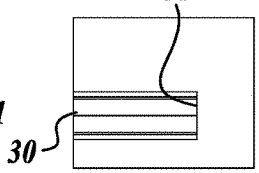
Figure 5H:
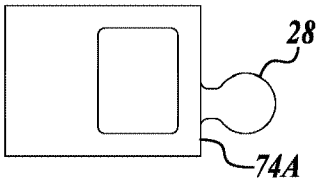
Figure 9A:
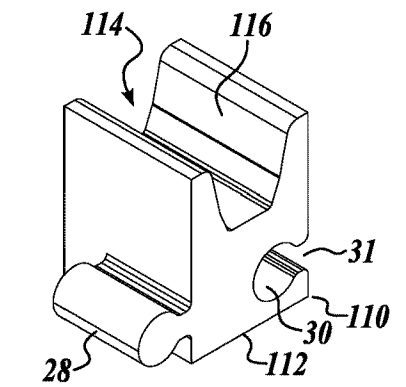
FIGS. 9A-9H illustrate another spacer component of the modular tool holder of FIG. 1.
Figure 9B:
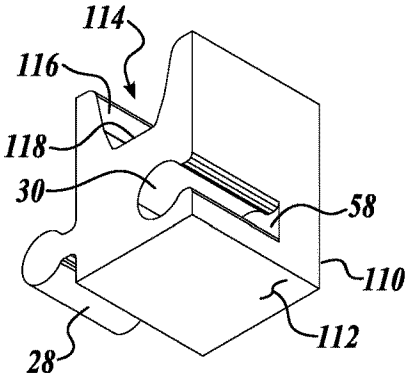
Figure 9C:
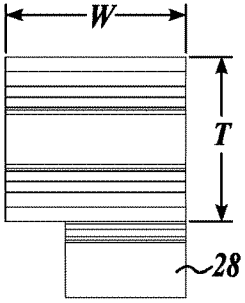
Figure 9D:
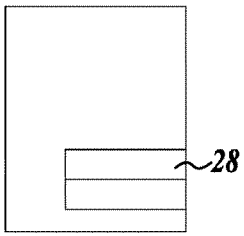
Figure 9E:
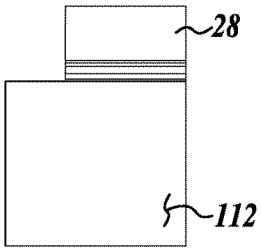
Figure 9F:
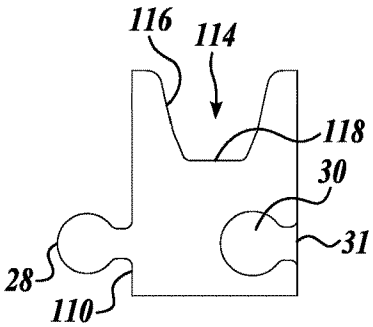
Figure 9G:
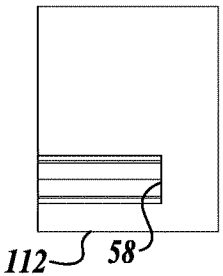
Figure 9H:
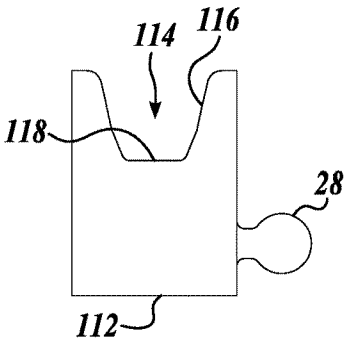

As shown in FIGS. 3B and 3G, the grooves 30 extend horizontally from the same side edges of the bases 26 as the tongues 28. The grooves 30 have a lead-in or opening 31 extending from the side of the body base 26 opposite to the direction of projection of the tongues 28 from the body base, thereby to slidably receive into the groove the tongue of the body base or spacer. The grooves 30 bottom or terminate at an end 58, which serves as a stop for the tongues 28 of the bodies 22 or of the spacers 32-40. This helps ensure that the bodies 22 and spacers 32-40 engage into alignment with each other when assembling the tool holder 20.

Figure 2:
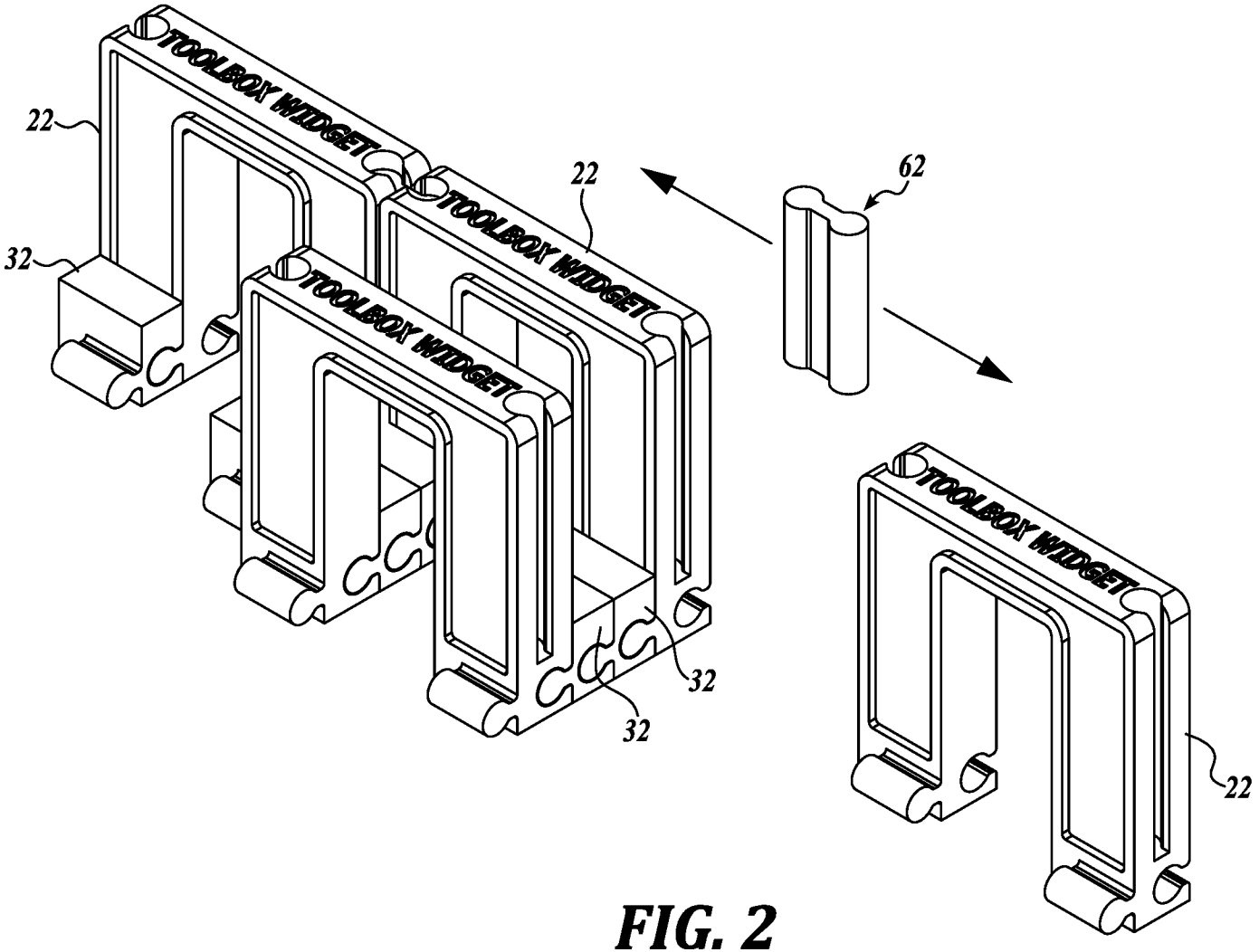
FIG. 2 illustrates the modular tool holder in a second possible configuration for holding tools.

Referring specifically to FIGS. 3A, 3B, 3C, 3F, 3H, vertical grooves 60 are formed in the outward edge portions of the body legs 50. As shown in FIG. 2, the vertical grooves 60 are shaped and sized to receive a connector 62 therein for connecting bodies 22 in side-by-side relationship to each other. In this manner the width of the tool holder can be increased as desired, for example, when holding a longer tool, such as a saw. The connector 62 is in the form of two elongate, parallel tongues with a spacer extending therebetween to be engageable in the vertical grooves 60 of adjacent bodies 22 so that the adjacent side edges of the legs 50 of the adjacent bodies are in close proximity to each other.

Next, describing the various spacers, a "standard" or "basic" spacer 32 is illustrated in FIGS. 4A-4H. Spacer 32 is generally rectilinear in shape, having a flat bottom surface 70 and a flat top surface 72. A horizontal tongue 28 projects from one side of the base portion 74 of the spacer 32. As in body 22, the tongue 28 extends horizontally relative to the spacer, but not the full width of the spacer. A groove 30 is formed in the base portion 74 of the spacer opposite to the tongue 28. The groove 30 has a lead-in or opening 31 extending outwardly from the opposite side of the spacer as the location of the tongue 28.

As in the groove 30 formed in the body base 26, the groove 30 formed in spacer 32 bottoms at an end 58, which serves as a stop for the tongues 28 of body 22 or the tongues 28 of the spacers 32-40 that may be engaged in the spacer groove 30. In this manner the spacer 32 is engaged in alignment with a body 22 or another spacer 32-40 when the tool holder 20 is assembled.

FIGS. 5A-5H disclose a spacer 34 which is constructed similarly to spacer 32, but of the greater thickness TA from the thickness of T of the spacer 32. Other than this difference, the spacer 34 is of the same construction as the spacer 32. Thus, such construction shall not be repeated here. The spacer 34 may be used between adjacent bodies 32 to hold, for example, small pliers P, which may be positioned to lie diagonally between two bodies 22. Of course, other types of tools may be supported by the spacer 34 and the adjacent bodies 22.

FIGS. 6A-6H disclose a spacer 35 which is constructed similarly to spacer 34, but of a greater thickness TB from the thickness TA of the spacer 34. Other than this difference, the spacer 35 is of the same construction as the spacer 34. Thus, such construction is not repeated here. The spacer 35 may be used between adjacent bodies 22 to hold, for example, large pliers. The large pliers can be supported by the spacer 34 between bodies 22 to lie diagonally between the bodies.

FIGS. 7A-7H disclose a spacer 36 which is configured to hold a screwdriver as shown in FIG. 1, or similar or other tool. The spacer 36 is constructed with a base portion 80 having a flat bottom 82. As in the spacers 32, 34, and 35 described above, the spacer 36 also includes a similarly constructed tongue 28 and groove 30, the construction of which will not be repeated here. Also, as in spacers 32, 34, and 35, the spacer 36, as shown in FIG. 1, extends to a height or elevation that is relatively lower than the height or elevation of the body 22, typically no more than about one quarter to about one third of the height of the body.

The spacer 36 is constructed with an upwardly open groove 84 for receiving downwardly therein screwdriver S or other tool. The groove 84 is formed by sloped lower side portions 86 that converge in the downwardly direction to an arcuate bottom 88. The groove 84 also includes sloped upper side portions 90 which are disposed at a lesser angle relative to the vertical than sloped lower side portions 86, thereby to serve as a lead-in for the screwdriver or other tool to be held by the spacer 36. Rather than being formed with compound sidewalls, the groove 84 can instead be formed from a substantially constantly sloped sidewalls leading downwardly into the arcuate bottom 88.

FIGS. 8A-8H disclose a spacer 38 which is configured to hold a wrench W or other tool, as shown in FIG. 1. The spacer 38 is constructed with a base portion 96 having a flat bottom 98, serving as a resting surface for the spacer in a manner of the body 22 and the other spacers described herein. As in the spacers 32, 34, 35, and 36 described above, the spacer 38 also includes a similarly constructed tongue 28 and groove 30, the construction of which will not be repeated here. Also, as in spacers 32, 34, 35, and 36, the spacer 38, as shown in FIG. 1, extends to height or elevation that is relatively lower than the height or elevation of the body 22, typically no more than about one quarter to about one third of the height of the body.

The spacer 38 is constructed with an upwardly open groove 100 for receiving downwardly therein a wrench W or other tool. The groove 100 is formed by upright, substantially vertical side wall portions 102 that extend downwardly to a bottom 104, thereby defining a generally U-shaped groove. Although the bottom 104 is shown as being substantially flat, the bottom can instead be arcuate, for example upwardly concave, so as to center the side edge of the wrench W into the groove 100. Also, rather than being substantially vertical, the side wall portions 102 can be sloped inwardly in a downward direction so as to automatically center the end of the wrench into the groove 100. As a further alternative, the side wall portions 102 can be disposed in sloped parallel relationship to each other so as to hold the wrench in diagonal orientation so that the overall height of the wrench in stored position is of a reduced height relative to if the wrench were disposed vertically within the spacer 38.

FIGS. 9A-9H disclose a spacer 40 which is configured to hold a wrench W1 that is larger than wrench W shown in FIG. 1, or other tool. The spacer 40 is constructed with a base portion 110 having a flat bottom 112, serving as a resting surface for the spacer in a manner of the body 22 and the other spacers described herein. As in the spacers 32, 34, 35, 36, and 38 described above, the spacer 40 also includes a similarly constructed tongue 28 and groove 30, the construction of which will not be repeated here. Also, as in spacers 32, 34, 35, 36, and 38, the spacer 40, as shown in FIG. 1, extends to a height or elevation that is relatively lower than the height or elevation of the body 22, typically no more than about one quarter to about one third of the height of the body.

The spacer 40 is constructed with an upwardly open groove 114 for receiving downwardly therein wrench W1 or other tool. The groove 114 is formed by inwardly sloped side wall portions 116 that extend downwardly and converge to a bottom 118, thereby defining a generally U-shaped groove, see FIGS. 9F and 9H. Although the bottom 118 is shown as being substantially flat, the bottom can instead be arcuate, for example upwardly concave, so as to center the side edge of wrench W1 or other tool into the groove 114. Also, rather than being inwardly sloped, the side wall portions 116 can be substantially vertical, but of a width larger than in the spacer 38, described above. As a further alternative, the side wall portions 116 can be disposed in sloped parallel relationship to each other so as to hold the wrench W1 or other tool in sloped orientation so that the overall height of the tool in stored position is of a reduced height relative to if the tool were disposed vertically/upright within the spacer 40.

FIGS. 10A-10H are directed to a tool holder body 122 which is constructed similarly to tool holder body 22, but with the riser 124 being sloped in the upward direction rather than being substantially upright as in riser 24 of body 22. As shown in FIG. 1, this construction enables tools, such as pliers P, to be held or stored in tilted orientation relative to the vertical. As such, the tools require less vertical clearance than if stored in an upright orientation. Thus, such tools can be stored in shallower drawers than if the tools were positioned in upright orientation.

Referring to FIGS. 10A-10H, other than the sloped orientation of riser 124 and an increased thickness of body base section 126, the tool holder body 122 is constructed substantially the same as tool holder body 22. As such, the corresponding features/components of tool holder body 122 are identified with the same part number as tool holder body 22, but in the '100 series.

As shown in FIGS. 10F and 10H, the body riser 124 is at an orientation of approximately 45° to the vertical. The riser 124 can be of other angles relative to the vertical, for example, anywhere from about 30° to about 60°. Also referring to FIGS. 10A and 10B, the thickness T of the body base section 126 is greater than the thickness T of the body base section 26. The greater thickness of the body base section 126 is to accommodate the sloped orientation of the riser 124. To this end, the body base section 126 is constructed with an integral spacer section 170 in which the groove 130 is formed. As can be appreciated, without the integral spacer section 170, the gap between adjacent tool holder bodies 122 may be too narrow to receive many tools.

As shown in FIGS. 10A, 10B, 10F, and 10H, a cavity 172 is formed in the base sections 126 to avoid having excessively thick wall sections in the base sections. The cavities 172 extend inwardly from the outer sides of the base sections to extend substantially through the base sections, but not all the way through. As an alternative construction, the cavities 172 could extend all the way through the base sections 126.

Another alternative to the foregoing construction is to form the groove 130 in the space corresponding to the location of the cavities 172. In that case, a spacer, such as a spacer 32, 34, or 35, could be employed between adjacent tool holder bodies 122.

FIGS. 1 and 2 illustrate how the components of the tool holder 20 may be assembled together. For example, in FIG. 1, beginning from the left-hand end of the tool holder, a body 22 forms the end of the tool holder, and is followed by three spacers 36 that are designed to hold screwdrivers S. Next a second body 22 is interspaced between the spacers 36 and a series of spacers 38 designed to hold wrenches W therein. The second body 22 serves several functions, including forming a division between different types of spacers as well as stabilizing the gap between the two spaced apart rows of spacers.

Next, a series of spacers 40 is positioned to the right of the spacers 38 to hold larger sized wrenches, or other tools. The last spacer 40 is connected with a body 22, which in turn is connected to a standard spacer 32 as well as to a second body 22 in side-by-side relationship, so that the tool holder is now two bodies wide. As discussed above, this enables the tool holder 20 to accommodate longer tools, for example a saw. Two standard spacers 32 are interposed between the first double row of bodies 22 and a second double row of bodies 22. Such second double row of bodies 22 is in turn connected to a first double row of slanted bodies 122, which in turn is connected to a second double row of slanted bodies 122.

Next thereafter, the slanted body 122, which is in alignment with the first body 22 at the far left end of the tool holder, is connected to further slanted body 122, which as illustrated in FIG. 1 is supporting pliers P. Next thereafter, spacers 35 are used to interconnect this last slanted body 122 with an upright end body 22.

FIG. 2 illustrates upright bodies 22 connected in side-by-side relationship to each other as well as connected to a further body 22 by a pair of standard spacers 32. It will be appreciated that the upright bodies 22 and 122 can be interconnected in innumerable combinations with the various spacers 32-40. As can also be appreciated the tool holder 20 is sufficiently modular to hold in stable condition virtually all the tools of the DIY enthusiast. Moreover, the tool holder 20 can be easily reconfigured to fit a different drawer or other space or to hold a different set of tools. In this regard, the tongues 28 of the tool holder bodies and spacers conveniently slide into secure engagement with an adjacent groove 30 of a tool holder body or spacer.

Figure 11:
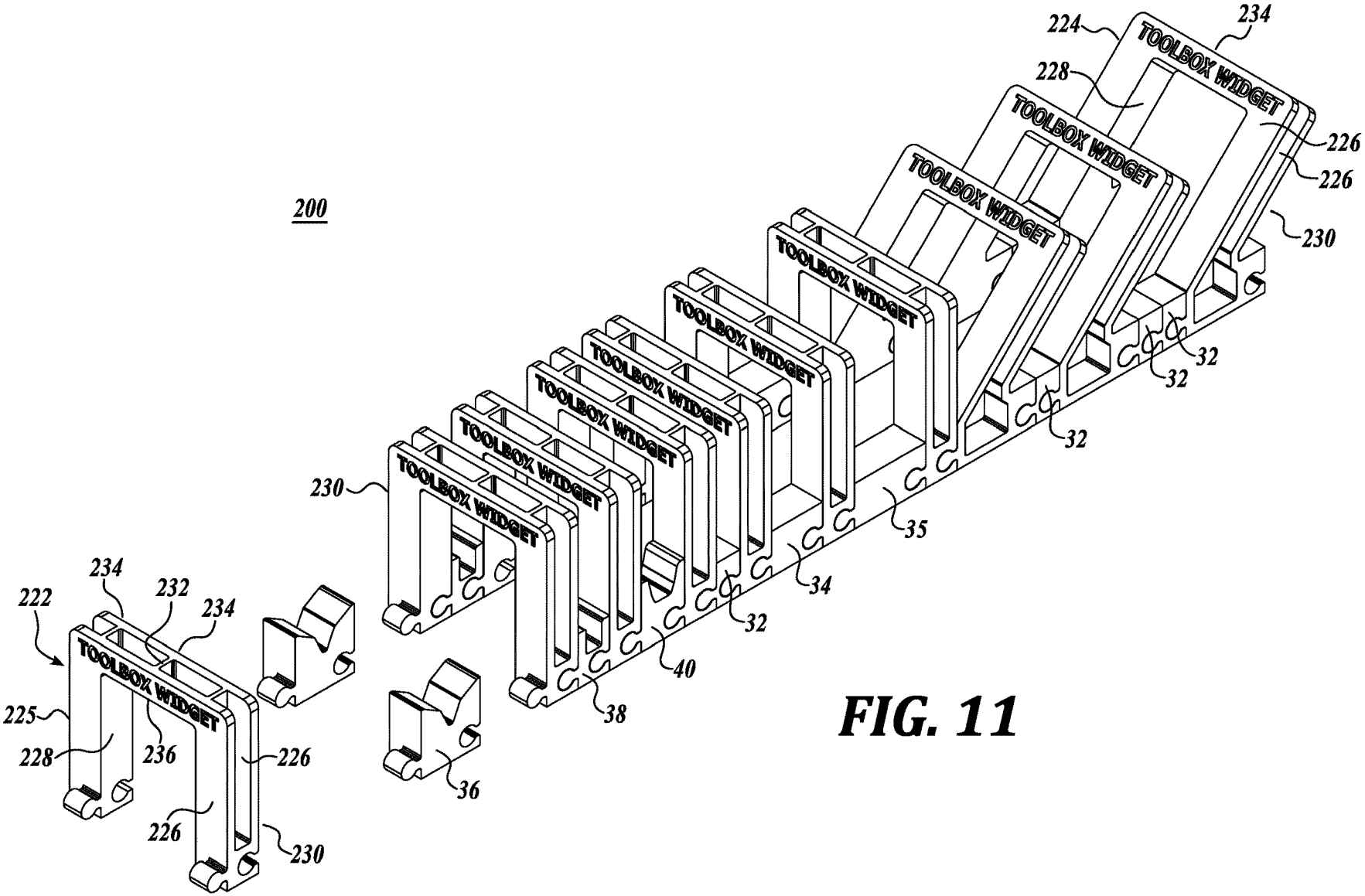
FIG. 11 is an isometric view of another modular tool holder of the present disclosure with portions shown in exploded view.
Figure 12:
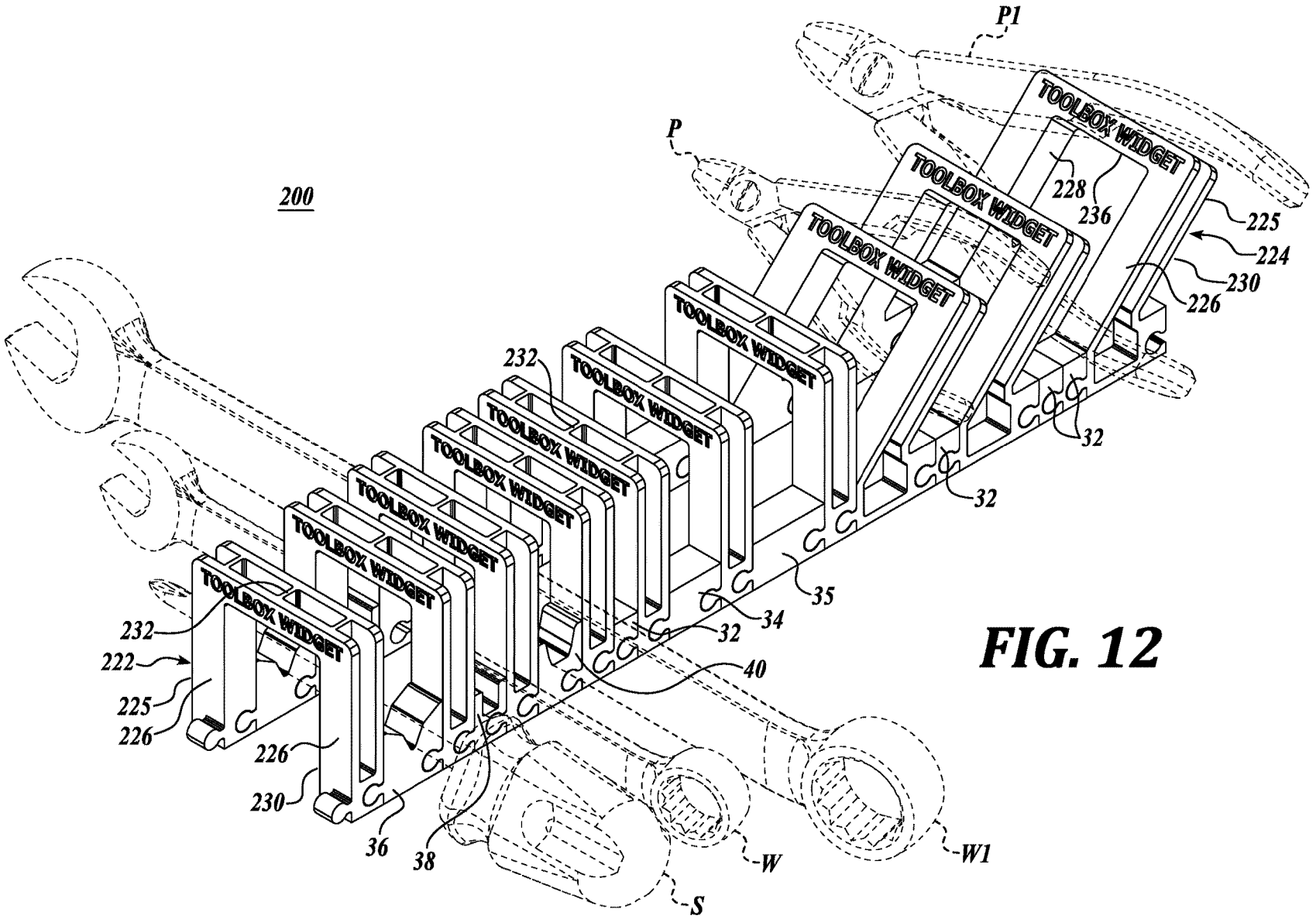
FIG. 12 is an isometric view of the modular tool holder shown in FIG. 11 assembled and holding various tools.

Next referring to FIGS. 11 and 12, an embodiment 200 of a tool holder is illustrated. The tool holder 200 includes upright bodies 222 and diagonal bodies 224 which are constructionally similar to bodies 22 and 122, including each having a groove formed in the base of the bodies and a tongue projecting from the base to engage within grooves of an adjacent body or of a tool supporting spacer 32, 34, 35, 36, 38, and 40.

However, one difference between tool holder 200 and tool holder 20 is that the bodies 222 and 224 are not designed to be connected together in side-by-side relationship to each other. Rather, the U-shaped riser 225 of the bodies 222 and 224 is composed of spaced apart face flanges 226 that are interconnected with transverse webs 228 extending upwardly along the insides of the body legs 230, as well as a center web 232 transversely interconnecting the bridging portions 234 of the face flanges 226. A further web 236 interconnects the lower edge portions of the bridging portions of the face flanges to cooperate with the webs 228 to form a continuous inside wall for the U-shaped riser 225, thereby adding significant structural integrity to the bodies 222 and 224. In substantially all other respects the tool holder bodies 222 and 224 are similar in construction and function to the tool holder bodies 22 and 122 discussed above.

While illustrative embodiments have been illustrated and described, it will be appreciated that various changes can be made therein without departing from the spirit and scope of the invention. For example, the riser 24 could be constructed as a continuous member extending across the width of the body, rather than being constructed with spaced apart legs 52 that define a gap 53 there between. Further, rather than utilizing two spacers 32-40 in side-by-side relationship on the opposite sides of the gap 53, the spacers can extend across the entire width of the bodies 22 or 122, in which case the necessity of needing a body 22 or 122 so as to maintain the side-by-side spacing of the spacers 32-40 would be reduced. Also, the upper surfaces of the spacers 32-40 can be of other contours so as to receive and support other types of tools, or tools of different sizes than as illustrated or described above.

As an example, tongue 28 and groove 30 are shown as being circular cross-section. However, the tongue and groove can be of other cross-sectional shapes, such as triangular, ovoid, square, rectangular, etc. as long as the overall size (width/thickness) of the tongue is greater than the width of the groove opening.

The embodiments of the invention in which an exclusive property or privilege is claimed are defined as follows:

1. A modular tool holder for holding an array of different mechanic's tools, comprising:

at least one upwardly extending body, the body comprising a base defining the bottom of the modular tool holder and a riser extending upwardly from the base, the riser forming the width and height of the body to cooperatively define a planar abutment;

at least one spacer defining a height and a width, the spacer comprising a base and an upper surface opposite to the base of the spacer to form a tool supporting surface;

the body base and the spacer base each defining at least one groove formed therein and at least one tongue projecting from the body base and the spacer base to be engageable within the groove of an adjacent body base or spacer base;

at least one spacer disposable between adjacent bodies for supporting a tool on the upper surface of the spacer; and the riser of the body extending upwardly from the base of the body and also extending upwardly above the upper surface of the spacer to position the abutment to enable a tool supported by the spacer to bear against the abutment.

2. The modular tool holder of claim 1, the body riser comprising:

laterally spaced apart legs extending upwardly from the body base, the legs defining a gap therebetween, with the legs and the gap defining the width of the body; and a bridge section spanning the spaced apart legs at a location distal from the body base.

3. The modular tool holder of claim 2, wherein:

the legs having upper end portions, and the bridge section spanning the upper end portions of the legs.

4. The modular tool holder of claim 2, wherein: the legs having a width, and the spacer is a width corresponding to the width of the legs.

5. The modular tool holder of claim 4, wherein an upwardly open groove is formed in the upper surface of the spacer for receiving a tool downwardly therein.

6. The modular tool holder of claim 5, wherein the upwardly open groove is defined by side surfaces and a groove base.

7. The modular tool holder of claim 6, wherein the side surfaces of the groove are sloped.

8. The modular tool holder of claim 1, wherein an upwardly open groove is formed in the upper surface of the spacer for receiving a tool downwardly therein.

9. The modular tool holder of claim 8, wherein the upper surface of the spacer is defined by side surfaces and a groove base.

10. The modular tool holder of claim 9, wherein the side surfaces of the groove are sloped.

11. The modular tool holder of claim 1, wherein the body riser defining side edges and a groove extending along the riser side edges.

12. A modular tool holder, comprising:

at least one upwardly extending body defining a height and a width, the body comprising a base and the riser extending upwardly from the base, the riser defining the width and height of the body;

at least one spacer defining a height and a width, the spacer comprising a base;

the body base and the spacer base each defining at least one groove formed therein and at least one tongue projecting from the body base and the spacer base to be engageable within the groove of an adjacent body base or spacer base;

at least one spacer disposable between adjacent bodies for holding a tool;

wherein the body riser defining side edges and a groove extending along the riser side edges; and further comprising connectors engageable into the grooves extending along the riser side edges to interconnect the risers of adjacent bodies in side-by-side relationship to each other.

13. The modular tool holder of claim 12, wherein the connectors defining side-by-side tongue sections.

14. A modular tool holder for holding an array of different mechanic's tools, comprising:

at least one upwardly extending body, the body comprising laterally spaced apart legs each extending upward from a base section, the base section forming the bottom of the modular tool holder, the spaced apart legs defining a gap there between and a bridge section spanning the spaced apart legs at a location spaced from the leg base sections, the legs and bridge section cooperatively defining a planar abutment;

at least one tool supporting spacer defining a height and a width, the spacer comprising a base section and an upper surface opposite to the base of the spacer to form a tool supporting surface;

the body and the spacer base sections each defining at least one groove formed therein and at least one tongue projecting from the body and the spacer base sections to be engageable within the groove of an adjacent body or spacer base section;

at least one spacer disposable between adjacent bodies for supporting a tool between the adjacent bodies; and the spaced apart legs of the body extending upwardly from the base section of the body and also extending upwardly above the upper surface of the spacer to position the abutment to enable a tool supported by the spacer to bear against the abutment.

15. The modular tool holder of claim 14, wherein the legs defining a gap therebetween, with the legs and the gap defining the width of the body.

16. The modular tool holder of claim 14, wherein the bridge section defining the height of the body.

17. The modular tool holder of claim 14, wherein an upwardly open groove is formed in the upper surface of the spacer for receiving a tool downwardly therein.

18. The modular tool holder of claim 17, wherein the upwardly open groove is defined by side surfaces and a groove base.

19. The modular tool holder of claim 18, wherein the side surfaces of the groove are sloped.

* * * * *